United States Patent [19]

Schildkraut et al.

[11] 4,268,103

[45] May 19, 1981

[54] ELECTRICAL CONNECTOR ASSEMBLY HAVING ANTI-DECOUPLING MECHANISM

[75] Inventors: Alan L. Schildkraut; Vincent A. Luca, Jr., both of Sidney; Carl L. Knapp, Oneonta, all of N.Y.

[73] Assignee: The Bendix Corporation, Southfield, Mich.

[21] Appl. No.: 8,714

[22] Filed: Feb. 2, 1979

[51] Int. Cl.[3] ..... H01R 13/639

[52] U.S. Cl. ..... 339/89 M; 285/88; 339/113 R

[58] Field of Search ..... 339/89 R, 89 CM, 90 R, 339/90 C, 91 R, 113 R; 285/87, 88, 308; 74/575-577 S

[56] References Cited

U.S. PATENT DOCUMENTS

| | | | |
|---|---|---|---|
| 2,984,811 | 5/1961 | Hennessey et al. | 339/90 R X |
| 3,594,700 | 7/1971 | Nava | 339/91 R X |
| 3,601,764 | 8/1971 | Cameron | 339/89 M |
| 3,862,580 | 1/1975 | Pulles | 74/577 S |
| 4,066,315 | 1/1978 | Arneson | 339/89 M |
| 4,109,990 | 8/1978 | Waldron et al. | 339/89 M |
| 4,152,039 | 5/1979 | Shah | 339/89 M |

FOREIGN PATENT DOCUMENTS

| | | | |
|---|---|---|---|
| 1181236 | 2/1970 | United Kingdom | 285/82 |

*Primary Examiner*—Eugene F. Desmond
*Attorney, Agent, or Firm*—Kenneth A. Seaman; Raymond J. Eifler; Charles D. Lacina

[57] ABSTRACT

An electrical connector assembly in which the electrical connectors may be quickly and easily coupled and decoupled, with a mechanism for preventing accidental decoupling of the connectors as a result of vibration. The connector assembly includes first and second connectors, which are coupled by the provision of a coupling nut mounted on one connector and having an internal screw thread which is adapted to receive a screw thread on a second connector. The mechanism for preventing accidental decoupling includes a spring mounted to the coupling nut and having a plastic forward face for engaging ratchet teeth carried on the edge of the housing. The ratchet teeth are more steeply on the leading edge engaged during decoupling and more gradually angled on the leading edge during coupling, allowing for easy coupling and a greater resistance to decoupling.

9 Claims, 12 Drawing Figures

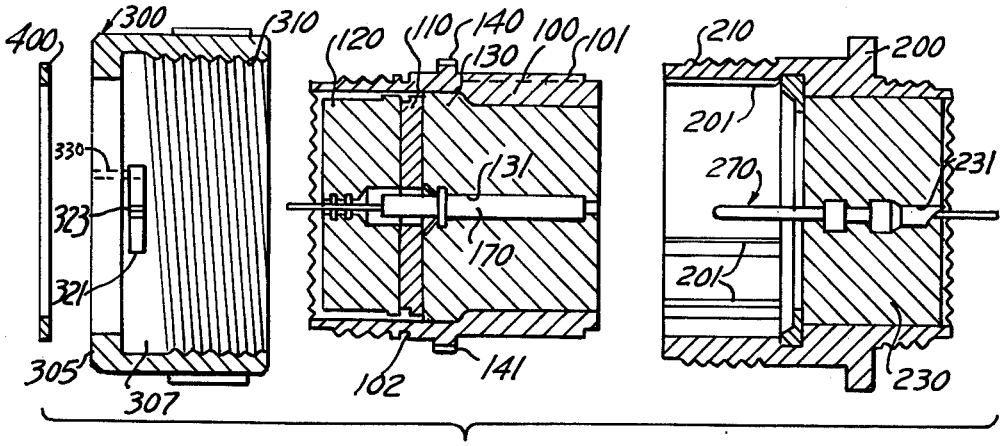
FIG. 1
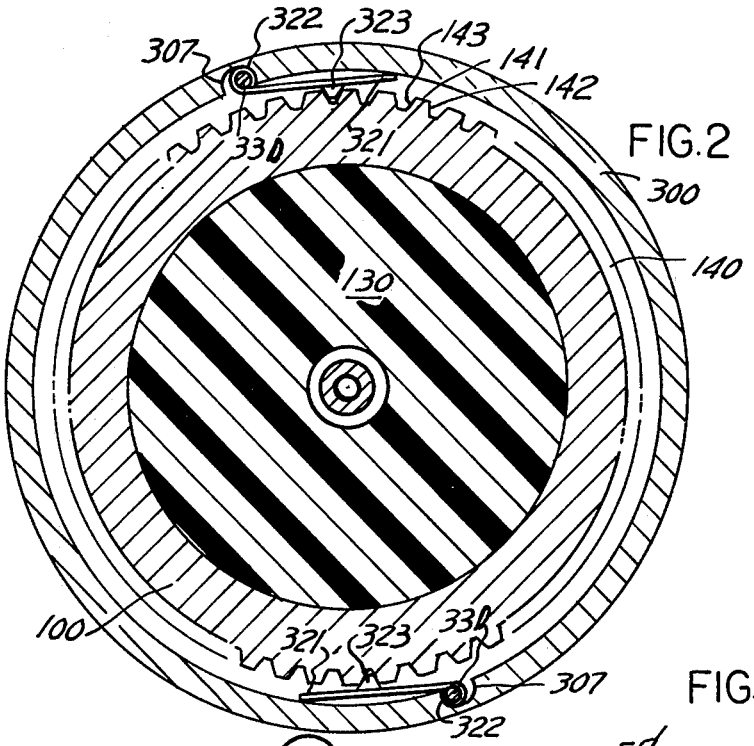
FIG. 2
FIG. 11
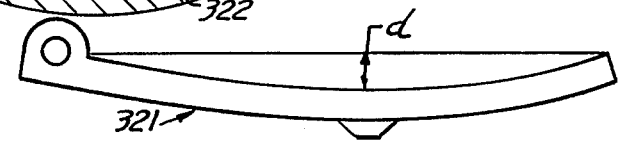
FIG. 12
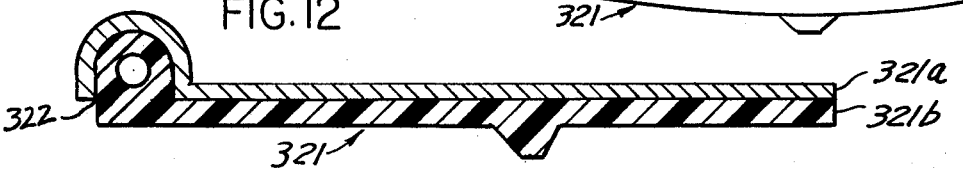

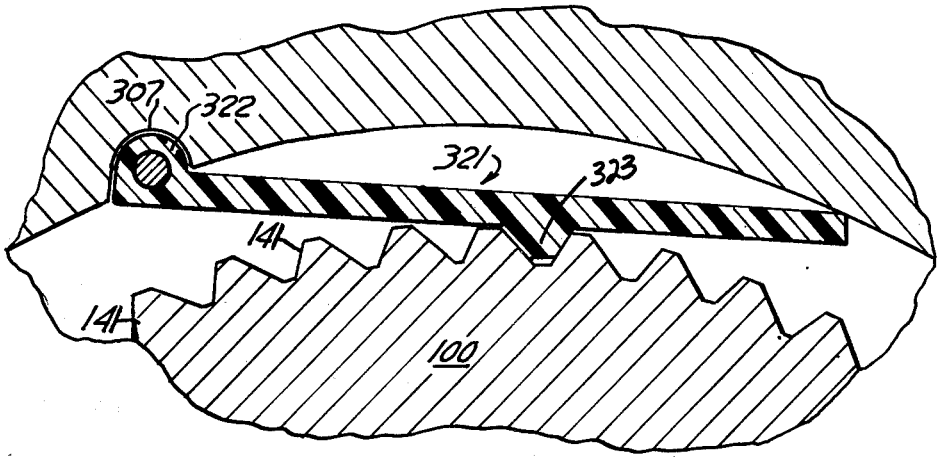
FIG. 3
FIG. 4
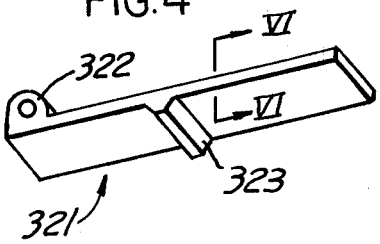
FIG. 5
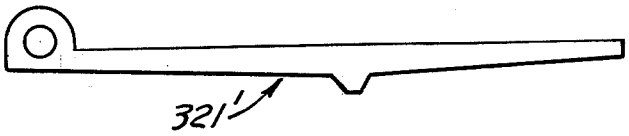
FIG. 6
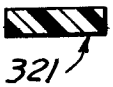
FIG. 8
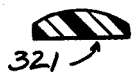
FIG. 10
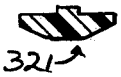
FIG. 7
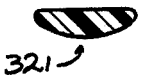
FIG. 9
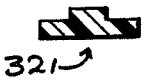

ELECTRICAL CONNECTOR ASSEMBLY HAVING ANTI-DECOUPLING MECHANISM

CROSS REFERENCE TO RELATED PATENTS

The present invention is related to and an improvement upon U.S. Pat. No. 4,109,990 to C.L. Knapp, et al. for "Electrical Connector Assembly Having Anti-Decoupling Mechanism". The specifications and drawings of this patent are hereby specifically incorporated herein by reference and are subsequently referred to as the "Connector Spring/Ratchet Patent".

FIELD OF THE INVENTION

The present invention relates to electrical connectors of the type having mating electrical contacts mounted therein. More particularly, the present invention relates to an improved assembly for obtaining electrical connectors within the assembly together and preventing accidental separation of the connectors through vibrational or other forces.

BACKGROUND OF THE INVENTION

The prior art has suggested many approaches for maintaining a pair of assembled electrical connectors together. One such approach includes providing one connector with a plurality of spaced bayonets which are located within similarly spaced detents carried by the coupling nut when the assembly is fully mated. One such example is shown in U.S. Pat. No. 2,984,811 to Hennessey, et al.

Other examples of methods of maintaining connectors together are described in U.S. Pat. Nos. 3,594,700; 3,601,764; and 4,066,315 and British Pat. No. 1,181,236. These patents have the general limitation that the mechanism for preventing accidental decoupling of the connectors is either complex, unreliable, costly to manufacture, or provides an undesirable hinderance to either assembly or disassembly when desired.

The reference Connector Spring/Ratchet Patent overcomes most of these limitations by providing a connector assembly which resists accidental decoupling while being relatively inexpensive to manufacture and assemble. The connector assembly disclosed in that patent includes a leaf spring mounted to the coupling nut and ratchet teeth carried on the outside of the connector. In the use of such connector assemblies, it has been noted that all types of leaf springs are not equal in performance. Metallic springs, which are probably first considered material, have several undesirable features. Repeated coupling and decoupling of the connectors causes a wearing or degradation of the metallic ratchet teeth and/or the spring, due to the metal-to-metal contact. The wearing of the metallic teeth creates metal particles or debris which accumulate within the area of the mating spring and teeth to interfere with the interaction between the spring and the teeth. Further, the wear of the spring creates an unpredictable and poor seating of the spring within the ratchet teeth that reduces the effectiveness of the decoupling mechanism. Lubrication to minimize the wear adds to the assembly cost and also presents a continuing maintenance factor which is undesirable.

Further, the manufacture of the metallic spring for the referenced Connector Spring/Ratchet Patent requires the two forming steps during manufacturing, one to produce a spring element, the second to produce the enlargement medially along the length. The second operation adds expense to the manufacturing process. Further, the use of the metallic spring limits the possible configurations of the enlargement which could be formed thereon.

Accordingly, the prior art systems for preventing accidental decoupling of mated electrical connectors had undesirable disadvantages.

SUMMARY OF THE INVENTION

This invention provides a quickly connectable and disconnectable electrical connector assembly which is reliable, easily coupled or decoupled when desired and is reasonably simple and inexpensive to manufacture. The present invention also overcomes the limitations of the metallic spring in the Connector Spring/Ratchet Patent by providing an assembly which avoids excessive wear on either ratchet teeth or the spring and needs no lubrication. The absence of wear eliminates the debris and the unpredictability of the seating of a spring in the teeth.

Further, the present invention is a anti-decoupling mechanism for connectors which allows considerable freedom in the shape of the spring member which is to be used, allowing a configuration of the spring member to be chosen to closely match the configuration of the ratchet teeth.

The present invention is an electrical connector assembly characterized by a coupling nut carrying a spring member having a projection, the spring member including a forward plastic face positioned to engage a plurality of gear teeth disposed on the periphery of the electrical connector shell to which it is attached. The coupling nut also includes a threaded projection for coupling with the threaded projection on a second electrical connector which is matable with the first connector. The coupling nut retains the first and second connectors in their mated relationship and prevents accidental decoupling through the resistance of the gear teeth and spring, which advantageously provides a larger resistance against decoupling forces while providing substantially smaller resistance to coupling forces. Thus, vibration and friction forces do not tend to decouple the connected electrical connector assembly.

While the spring member may be made totally of plastic (preferably a polyamide-imide such as Torlon brand), the preferred spring member design is a sandwich having a rear metal piece for strength and a forward plastic piece which are assembled together.

Accordingly, it is the object of the present invention to provide an improved electrical connector assembly that is inexpensive to manufacture, reliable, relatively easy to make and assemble while overcoming the disadvantages of prior art systems.

The foregoing and other objects and features of the present invention will become apparent from the following description of the drawings and claims, taking in conjunction with accompanying drawings which form a part of the specification. The use of reference numerals is for the purpose of clarification only and is not intended to limit the scope of the invention to the specific structure shown and described.

BRIEF DESCRIPTION OF THE DRAWINGS

FIG. 1 is a cross-sectional view of the components of an electrical connector assembly including the present invention, prior to assembly.

FIG. 2 is a cross-sectional view of the electrical connector, when assembled.

FIG. 3 shows an enlarged cross-sectional view of a spring member and ratchet teeth on the assembled connectors.

FIG. 4 shows a perspective view of one spring member of the present invention.

FIG. 5 shows a size view of an alternate embodiment of the spring member of FIG. 4.

FIG. 6 shows a cross-sectional view of the spring of FIG. 4, taken along the line VI—VI looking in the direction of the arrows.

FIGS. 7–10 are cross-sectional views of alternate embodiments of the spring member, similar to that shown in FIG. 6.

FIG. 11 shows a side view of another embodiment of a spring member of the present invention.

FIG. 12 shows yet another embodiment of the present invention, a spring member which is an assembly of a rear metallic portion and a forward plastic portion.

DETAILED DESCRIPTION OF THE DRAWINGS

FIG. 1 illustrates a cross-sectional, exploded view of an electrical connector assembly 10 which incorporates the principles of this invention. The electrical connector assembly 10 comprises a first shell 100, a second shell 200, and a coupling nut 300 mounted to the first shell 100 for connecting the first shell 100 and second shell 200 together. The typical components of the first shell 100 would include one or more female type (socket) electrical contacts 170 retained within the shell 100 by inserts 110, 120, 130. The outside of the first shell 100 generally includes a rear portion which is threaded for receiving a moisture sealing and/or strain relief nut (not shown) and a forward portion that includes one or more axially extending projections or keys 101 for orienting the first shell with respect to the second shell. The contacts 170 are mounted within passages 131 through the inserts. The shell 100 includes a medial enlargement 140, on which a plurality of gear teeth 141 extend around the outer periphery.

The second shell 200 includes one or more axially extending recesses or keyways 201 for receiving the respective keys 101 on the first shell 100. The second shell includes one or more male type (pin) electrical contacts 270 that mate the socket type contacts 170 of the first shell. The contacts 270 are retained in the second shell 200 by one or more inserts 230. The insert 230 includes a passage 231 along with suitable means for retaining the contacts within the passage. The shell 200 includes forward external thread 210.

The coupling nut 300 is mounted over the rear of the first shell 100, with the medial enlargement 140 providing a forward stop for the coupling nut 300. A snap ring 400 is mounted in a groove 102 on the first shell and serves to limit the rearward movement of the assembled coupling nut 300 thereby captivating a rear portion 305 of the coupling nut 300 between the ring 400 and the flange 140. The coupling nut 300 includes internal threads 310 which are adapted to mate with the external threads 210 on the second shell to bring the first and second shells together with the contacts mated. A spring member 321 is mounted toward the rear of the coupling nut 300 by a pin 330. The spring member 321 includes a medial projection 323. As shown in FIG. 2, the flange or medial enlargement 140 of the first shell 100 has a plurality of gear teeth 141 extending around the periphery.

The coupling nut 300 carries springs 321 mounted thereto by pins 330. The spring 321 has the medial projection 323 and a looped end portion 322. The looped end portion 322 is mounted within an undercut portion 307 of the coupling nut and is secured by the pin 330 which extends from the rear of the nut.

Two such springs 321 are shown in FIG. 2. These are symmetrically arranged about the periphery of the connector. While two springs probably provide adequate resistance to decoupling forces for smaller connectors, in larger connectors, greater decoupling forces have been noted in comparison with the retarding forces of a single spring assembly. In these cases, additional spring elements could be provided, for instance, four springs spaced 90 degrees about the coupling nut. The four-spring arrangement is probably preferred, in fact, for all sizes of connectors.

FIG. 3 shows an enlarged view of an anti-decoupling apparatus of the present invention. The spring 321 is shown mounted in the undercut 307 of the coupling nut 300 and engages the gear teeth 141 on the first shell 100. As described in the referenced Connector Spring-/Ratchet Patent, the teeth 141 on the shell have a varying incline, with a more steep angled tooth edge on the leading edge during decoupling and a less-steeply angled tooth edge on the leading edge during coupling. This gives ease in coupling while providing a greater resistance to decoupling.

The spring member is made from a plastic material. More particularly, the present spring is preferably made from a plastic material which has good temperature characteristics, a high yield or distortion point, high tensile strength (stress level endured before breaking), capable of being molded flash-free in injection molding, and has a high elongation under stress before breaking without high cost. As applicants' connector is designed to MIL Spec. 38999 and its high temperature requirements, the preferred materials are high temperature thermoplastic plastic or polymers, and the most preferred material is a polyamide-imide such as is sold by Amoco under the trademark "Torlon 4203-L". Such material is more accurately a substantially non-filled, thermo-setting thermoplastic material, which is used in its thermo-setting mode by properly curing it. Such material may be molded conveniently in the desired shape and configuration necessary for the spring. Other high temperature materials, which could be used to advantage, are polyamides (such as duPont sells under its trademark Zytel), polyphenylene sulfide resins (such as Phillips 66 sells under its Ryton trademark), polyphenylene sulfone (e.g. Union Carbide's Radon) polyether sulfone or polyphenylene sulfides. Thermosetting materials, especially with glass fill for strength (e.g., polyethylene, DAP, polystrene, epoxies, phenolics and melamines) could also be used in the present design, especially if high temperature endurance is not required. Also, suitable plastic alloys are believed to be appropriate in the present design.

The enlarged medial portion 323 on the spring member 321 has a shape which complements and interfits with the teeth 141 to allow a rather long (and therefor good) engagement between the portion 323 and the teeth 141. Unlike the prior art metal spring (where the shape of the enlarged medial portion was limited by the possible stamped shapes for the metal), the plastic spring can be molded to the desired shape. Further, since the plastic spring does not degrade (to any significant degree) either the teeth or itself, the initial shape of the teeth and medial portion 323 is substantially the shape at any time thereafter, so there is always a good engagement of the teeth by the medial portion 323.

The medial portion 323 has a flat top which is substantially parallel to the length of the spring member 321. The flat top is spaced from the bottom of the gear teeth 141, and flattened tops of the gear teeth do not touch the spring member 321.

As shown in FIG. 4, the spring 321 has a relatively uniform thickness throughout its length and across its width, except for the looped end 322 and the enlarged medial portion 323 which extends entirely across the spring.

FIG. 5 shows an alternate embodiment, wherein the spring 321' includes a beam which has a thickness which varies along its length from a relatively smaller thickness at its ends to a relatively larger medial portion.

FIG. 6 shows a cross section of the spring of FIG. 4. The spring 321 has a rectangular cross section.

FIGS. 7–10 show alternate cross-sectional views of a spring 321 similar to that shown in FIG. 6, which may be desired in some applications.

FIG. 7 illustrates a spring 321 in which the lower portion is bowed with an enlarged medial portion.

FIG. 8 shows a beam 321 in which the upper surface is bowed with an enlarged medial portion.

FIG. 9 shows an alternate embodiment of the spring 321 in which the upper surface has a strengthening rib extending along its length, down the middle of the spring.

FIG. 10 shows a modification of the cross section of the spring 321 of FIG. 9, in which the upper portion has the strengthening rib and the lower portion has angled tapered side surfaces.

FIG. 11 shows yet another configuration of a spring 321 of the type shown in FIGS. 3–5 wherein the spring is molded with a slight outward curvature to provide an initial preload condition. The outward curvature of the spring extends radially inward when mounted to the coupling nut. It has been found that some plastics used in the present invention have a tendency to relax under stress. The amount of relaxation is predictable for a given amount of stress and size of spring, and can be compensated by the initial preload or inward extension by a dimension d.

FIG. 12 shows yet another embodiment of the present invention, which is believed to be preferred for many connector applications. In this embodiment, the spring 321 includes a sandwich assembly: a rear or outer portion 321*a*, preferably made of metal, and a forward or inner portion 321*b* made of plastic. The portions 321*a*, 321*b* are suitably connected with the metal portion including a hooked end which snaps over the looped end portion 322 of the plastic portion. The rear portion 321*a* is a strengthening beam and may be made of any suitable material which gives rigidity while allowing the flexing of the spring 321. Metals appear best, and a spring steel beam of approximately 0.006 inches thickness appears most desirable. Such a sandwich-type spring assembly provides the advantages of both materials. The resulting spring 321 has the greater strength of the metal and the forward engaging surface of plastic which eliminates the wearing of the metal ratchet teeth. In some applications, it is expected that the plastic would not have the necessary strength and such a two-material sandwich spring would be desirable.

While a preferred embodiment of the invention has been disclosed, it will be apparent to those skilled in the art that many changes may be made to the invention with the spirit as set forth in the preceding description. Further, in some instances, certain features of the invention may be used to advantage without corresponding use of other features. For example, other configurations of plastics spring, or springs having plastic portions engaging the metal teeth, may be desirable. In some instances, the substitution of plastic for the ratchet teeth may be advisable, which would allow the use of a metal spring. Accordingly, it is intended that the preceding description of the invention be used merely to illustrate the principle of the invention and not to limit the scope thereof, which is set forth in the following claims.

Having thus described the invention, what is claimed is:

1. An electrical connector assembly comprising:

a first electrical connector shell having an insert with a plurality of axial passages having electrical contacts mounted therein;

a second shell having an insert with a plurality of axial passages extending therethrough and a plurality of electrical contacts matable with the contacts in the first shell, said second shell having an external thread thereon;

a coupling nut for selectively coupling and maintaining said first and second shells together and holding said respective contacts together in a mated relationship, said coupling nut being mounted for rotational movement on the first shell with internal thread means connectable with the threads on the second shell for connecting the first and second shells together in a mated relationship; and means for retarding the rotational movement of the coupling nut with respect to the shells, said retarding means comprising:

an annular shoulder mounted on one of the shells and extending radially outward from the one shell toward the coupling nut, said annular shoulder provided with teeth on the outside surface thereof; and an elongated spring having a pair of ends, one end having a looped end portion for pivotal mounting of said spring to the coupling nut and the other end resting freely on an interior portion of the coupling nut spaced from the one end mounting the spring to the coupling nut, said spring comprising a plastic member and a metallic member, said plastic member including said looped end portion and having a plastic surface facing in the direction of said teeth, said metallic member including an arcuately-shaped portion in which at least a portion of said looped plastic end portion is mounted, said plastic surface including an integrally molded enlarged portion that extends inwardly in a radial direction from an imaginary straight line between the ends of said spring to the coupling nut towards the shell for engaging the teeth to retard rotational movement.

2. An electrical connector assembly of the type described in claim 1 wherein said metallic member is a thin piece of spring steel.

3. An electrical connector assembly comprising:

a first electrical connector shell having an insert with a plurality of axial passages having electrical contacts mounted therein;

a second shell having an insert with a plurality of axial passages extending therethrough and a plurality of electrical contacts matable with the contacts in the first shell, said second shell having an external thread thereon;

a coupling nut for selectively coupling and maintaining said first and second shells together and holding said respective contacts together in a mated relationship, said coupling nut being mounted for rotational movement on the first shell with internal thread means connectable with the threads on the second shell for connecting the first and second shells together in a mated relationship; and means for retarding the rotational movement of the coupling nut with respect to the shells, said retarding means comprising:

an annular shoulder mounted on one of the shells and extending radially outward from the one shell toward the coupling nut, said annular shoulder provided with teeth on the outside surface thereof; and an elongated spring assembly including a member of plastic and strengthening beam of metal coupled to the plastic member, said spring having one end pivotally mounted to the coupling nut and the other end resting freely on an interior portion of the coupling nut spaced from the end mounting the spring to the coupling nut, said spring having a plastic surface facing in the direction of said teeth, said plastic surface including an integrally molded enlarged portion mediate along its length that extends inwardly in a radial direction from an imaginary straight line between the ends of the spring to the coupling nut towards the shell for engaging the teeth to retard rotational movement.

4. An electrical connector assembly of the type described in claim 3 wherein said metal strengthening beam is a spring steel beam.

5. An electrical connector assembly comprising:

a first electrical connector shell having an insert with a plurality of axial passages having electrical contacts mounted therein;

a second shell having an insert with a plurality of axial passages extending therethrough and a plurality of electrical contacts matable with the contacts in the first shell, said second shell having an external thread thereon;

a coupling nut for selectively coupling and maintaining said first and second shells together and holding said respective contacts together in a mated relationship, said coupling nut being mounted for rotational movement on the first shell with internal thread means connectable with the threads on the second shell for connecting the first and second shells together in a mated relationship; and means for retarding the rotational movement of the coupling nut with respect to the shells, said retarding means comprising:

an annular shoulder mounted on one of the shells and extending radially outward from the one shell toward the coupling nut, said annular shoulder provided with teeth on the outside surface thereof; and a spring comprising first and second elongated and generally parallel members held in close proximity along their length, said spring having one end pivotally mounted to the coupling nut and the other end resting freely on an interior portion of the coupling nut spaced from the one end mounting the spring to the coupling nut, said spring having a plastic surface facing in the direction of said teeth, said plastic surface including an integrally molded enlarged portion that extends inwardly in a radial direction from an imaginary straight line between the ends of said spring to the coupling nut towards the shell for engaging the teeth to retard rotational movement.

6. An electrical connector assembly of the type described in claim 5 wherein the first member is plastic and is located within the coupling nut radially inwardly of the second member.

7. An electrical connector of the type described in claim 6 wherein the second member comprises a metallic member.

8. An electrical connector of the type described in claim 7 wherein the metallic member has spring properties.

9. An electrical connector of the type described in claim 8 wherein the metallic member comprises a spring steel.

* * * * *